US005618072A

United States Patent [19]

Pitchford

[11] Patent Number: 5,618,072

[45] Date of Patent: Apr. 8, 1997

[54] REMOTE CONTROLLED DOOR BRACE

[76] Inventor: Paul P. Pitchford, 117 55th St. SE., Washington, D.C. 20019

[21] Appl. No.: 463,934

[22] Filed: Jun. 5, 1995

[51] Int. Cl.[6] ..... E05C 17/54

[52] U.S. Cl. ..... 292/339; 292/DIG. 15

[58] Field of Search ..... 292/339, 355, 292/2, 342, 343, DIG. 25, DIG. 15

[56] References Cited

U.S. PATENT DOCUMENTS

| | | | |
|---|---|---|---|
| 4,019,765 | 4/1977 | Nichola | 292/338 |
| 4,358,758 | 11/1982 | Morton | 292/339 X |
| 4,442,427 | 4/1984 | Morton | 292/339 X |
| 4,607,870 | 8/1986 | Crisp, Jr. et al. | 292/DIG. 15 X |
| 4,883,297 | 11/1989 | Smith | 292/339 |
| 5,098,138 | 3/1992 | Vandewege | 292/DIG. 15 X |
| 5,286,075 | 2/1994 | Monzingo | 292/339 |
| 5,333,922 | 8/1994 | Jones | 292/339 |
| 5,340,175 | 8/1994 | Wood | 292/339 |

*Primary Examiner*—Rodney M. Lindsey
*Assistant Examiner*—Monica E. Millner
*Attorney, Agent, or Firm*—Michael I. Kroll

[57] ABSTRACT

A remote controlled door brace for an entrance door with a doorknob in a building. The brace comprises a floor anchor mounted into the floor of the building, which is spaced away from the entrance door. A hanger engages with the doorknob on the interior side of the entrance door. A bar projects downwardly from the hanger. A motor is provided, while a structure is for securing the motor to a bottom end of the bar. An adjustable support extends between the motor and the interior side of the entrance door, so as to keep the motor at the proper angle away from the entrance door. A movable rod assembly extends from the motor to the floor anchor. A facility is for activating the motor on the exterior side of the entrance door, so as to operate the movable rod assembly to bear against the floor anchor and buttress the entrance door, to prevent an unauthorized person from jimmying open the entrance door and entering the building.

18 Claims, 2 Drawing Sheets

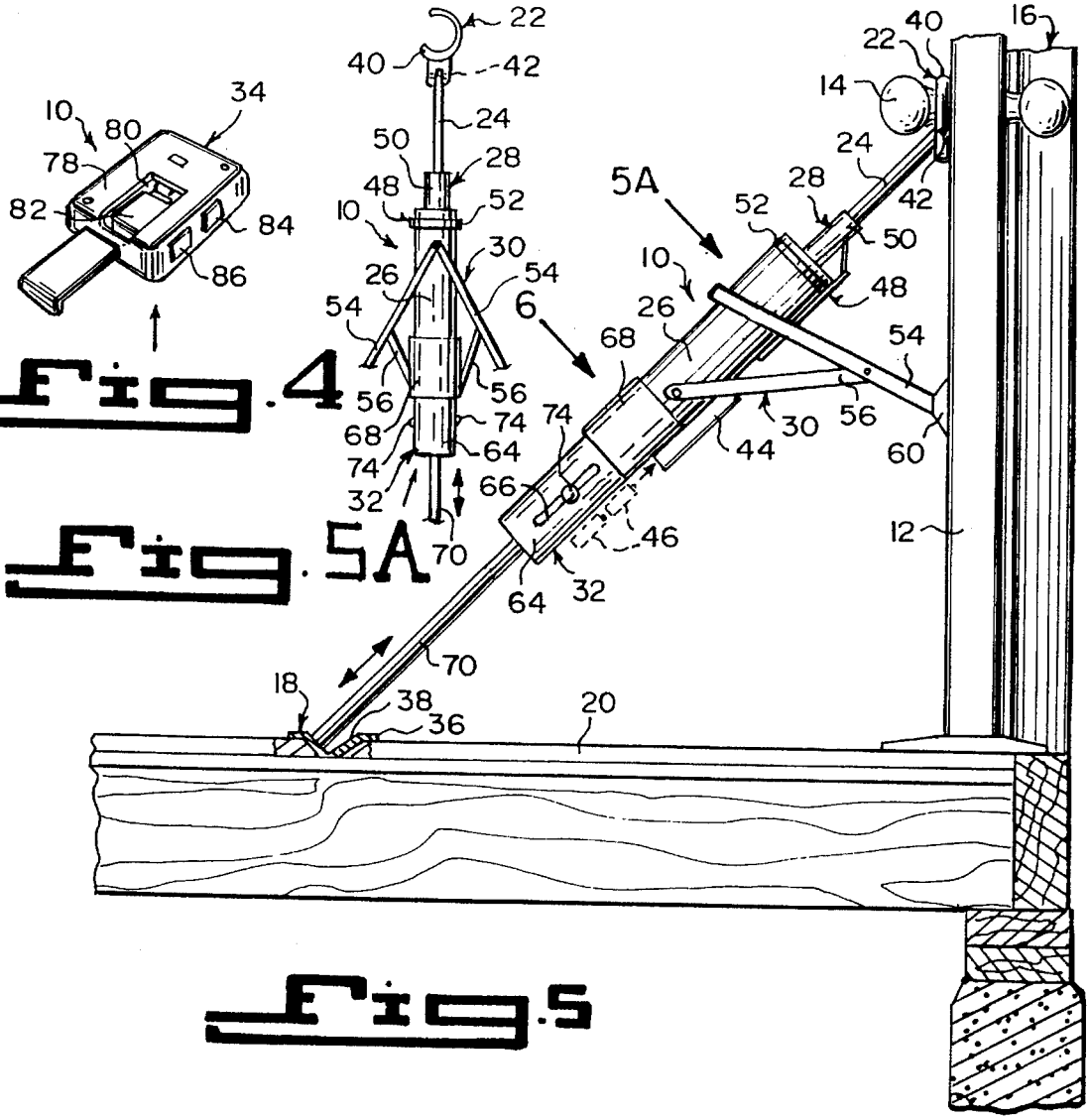
Fig. 4
Fig. 5A
Fig. 5
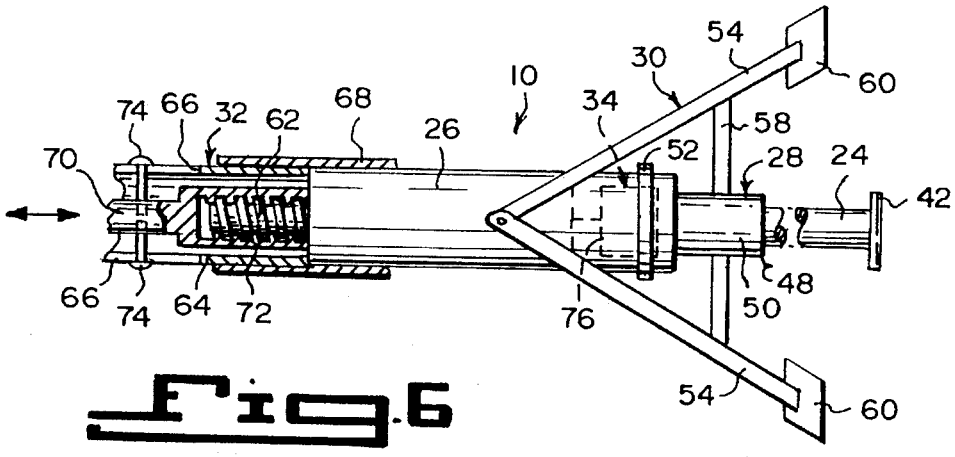
Fig. 6

REMOTE CONTROLLED DOOR BRACE

BACKGROUND OF THE INVENTION

1. Field of the Invention

The instant invention relates generally to security systems and more specifically it relates to a remote controlled door brace.

2. Description of the Prior Art

Numerous security systems have been provided in prior art that are adapted to prevent the unauthorized entry of a thief through doors and windows in buildings. While these units may be suitable for the particular purpose to which they address, they would not be as suitable for the purposes of the present invention as heretofore described.

SUMMARY OF THE INVENTION

A primary object of the present invention is to provide a remote controlled door brace that will overcome the shortcomings of the prior art devices.

Another object is to provide a remote controlled door brace that is an electronic device to buttress an entrance door of a building on the interior side by a person on the exterior side of the door operating a remote control transmitter unit.

An additional object is to provide a remote controlled door brace which will make it almost impossible for a person to jimmy open the entrance door to which the door brace is applied to and set by the remote control transmitter unit.

A further object is to provide a remote controlled door brace that is simple and easy to use.

A still further object is to provide a remote controlled door brace that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 2:
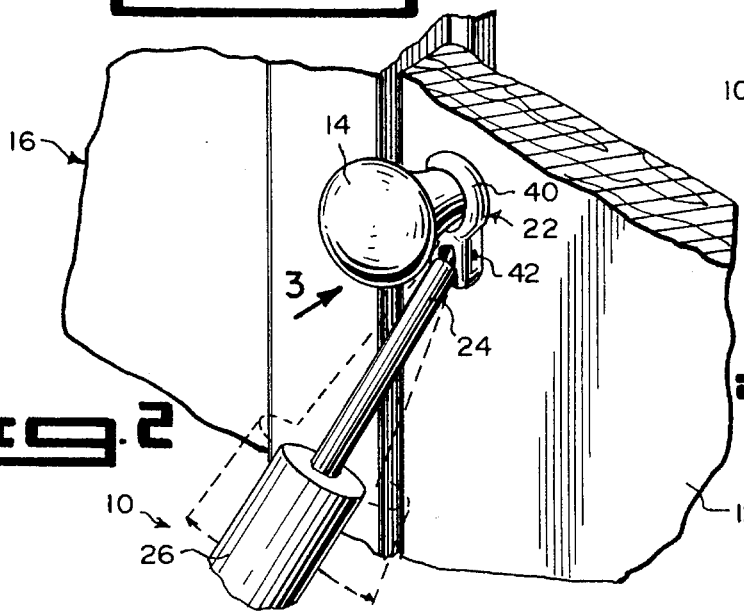
FIG. 2 is a perpsective view taken in the direction of arrow 2 in FIG. 1 with parts broken away.
Figure 3:
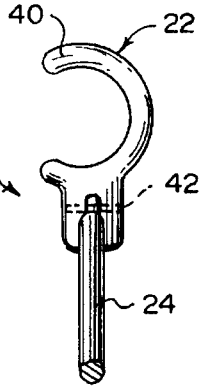

FIG. 3 an elevational view taken in the directon of arrow 3 in FIG. 2 with the hook disengaged from the doorknob.

Figure 1:
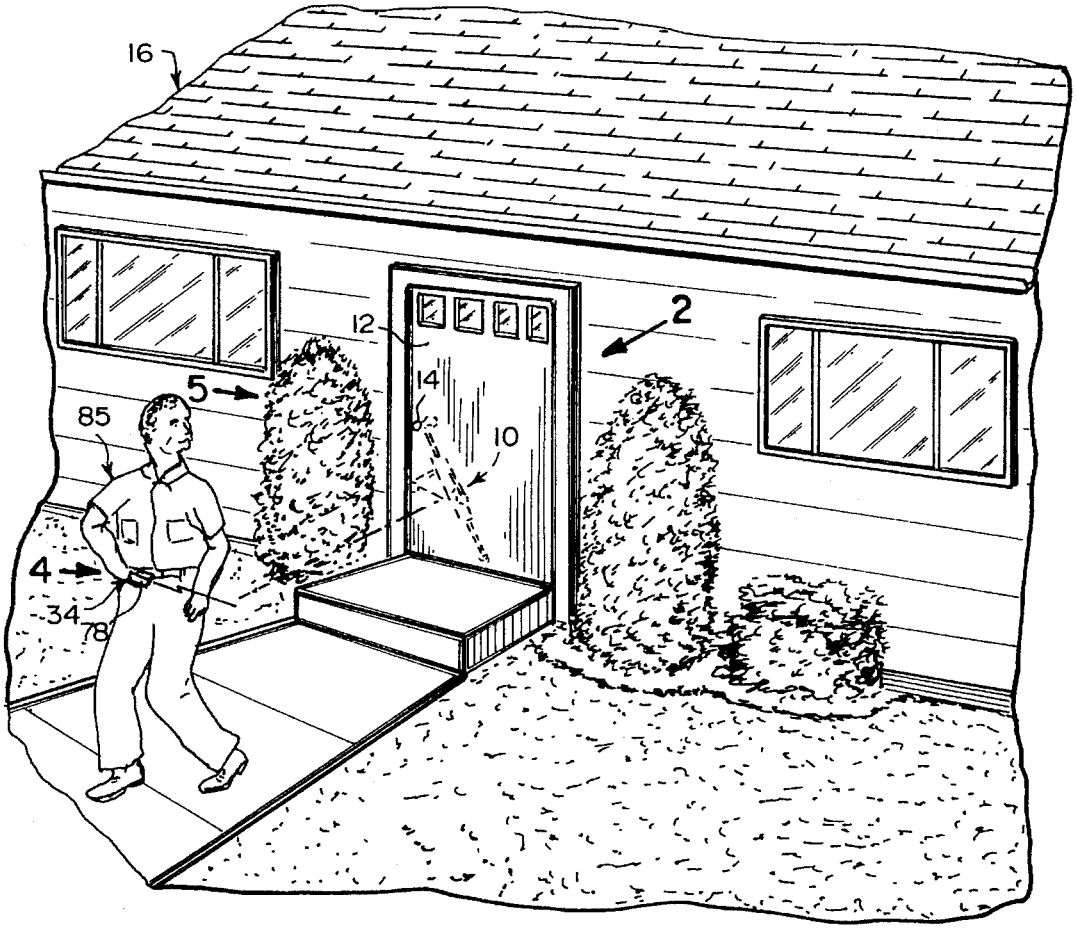
FIG. 1 is a perspective view of a building with the instant invention installed and activated by a person outside.

FIG. 4 is a perspective view of the hand-held remote control transmitter unit as indicated by arrow 4 in FIG. 1.

FIG. 5 is a side view with parts in section taken in the direction of arrow 5 in FIG. 1.

FIG. 5A is a front view of the instant invention with parts broken away taken in the direction of arrow 5A in FIG. 5.

FIG. 6 is an enlarged front view of the instant invention with parts broken away and in section taken in the direction of arrow 6 in FIG. 5.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 6 illustrate a remote controlled door brace 10 for an entrance door 12 with a doorknob 14 in a building 16. The brace 10 comprises a floor anchor 18 mounted into the floor 20 of the building 16, which is spaced away from the entrance door 12. A hanger 22 engages with the doorknob 14 on the interior side of the entrance door 12. A bar 24 projects downwardly from the hanger 22. A motor 26 is provided, while a structure 28 is for securing the motor 26 to a bottom end of the bar 24. An adjustable support 30 extends between the motor 26 and the interior side of the entrance door 12, so as to keep the motor 26 at the proper angle away from the entrance door 12. A movable rod assembly 32 extends from the motor 26 to the floor anchor 18. A facility 34 is for activating the motor 26 on the exterior side of the entrance door 12, so as to operate the movable rod assembly 32 to bear against the floor anchor 18 and buttress the entrance door 12, to prevent an unauthorized person from jimmying open the entrance door 12 and entering the building 16.

The floor anchor 18, as shown in FIG. 5, is a metal plate 36 having a socket 38 therein, mounted to the floor 20 of the building 16. The hanger 22 is a hook member 40 to fit about the doorknob 14 of the entrance door 12. The hook member 40 includes a pivot pin 42 to engage with a top end of the bar 24, to allow the bar 24 to swing out at a downward angle therefrom.

The motor 26, as shown in FIG. 5, contains a compartment 44 for string a pair of batteries 46 therein for supplying electrical power. The securing structure 28, as shown in FIGS. 5, 5A and 6, is a motor mount 48 which includes a collar 50 to fit about the bottom end of the bar 24. A strap 52 is affixed to the collar 50 and extends about a top end of the motor 26.

The adjustable support 30 consists of a pair of legs 54 attached to and extending from the motor 26. A pair of arms 56 are provided, in which each arm 56 is affixed to and extends between the motor 26 and approximately midway of one leg 54. A crossbar 58, shown in FIG. 6, extends between the legs 54. A pair of foot pads 60 are also provided. Each foot pad 60 is attached to a distal end of one leg 54, to butt up against the interior side of the entrance door 12.

In FIG. 6 of the remote controlled door brace 10, the motor 26 further includes an externally threaded shaft 62 extending outwardly from a bottom end thereof. The movable rod assembly 32 contains a housing 64, having a pair of opposite longitudinal slots 66. A sleeve 68 is for attaching the housing 64 to the bottom end of the motor 26, so that the externally threaded shaft 62 of the motor 26 will extend into the housing 64. An anchor rod 70 has an internally threaded socket 72 at an upper end, as shown in FIG. 6, to threadably engage with the externally threaded shaft 62 of the motor 26.

A pair of slide guide pins 74 are provided. Each slide guide pin 74 extends from an opposite side of the anchor rod 70 and through one longitudinal slot 66 in the housing 64. When the externally threaded shaft 62 of the motor 26 rotates in a forward direction in the internally threaded socket 72 of the anchor rod 70, the bottom end of the anchor rod 70 will bear against the floor anchor 18 to buttress the entrance door 12. When the externally threaded shaft 62 of the motor 26 rotates in a reverse direction in the internally threaded socket 72 of the anchor rod 70, the bottom end of the anchor rod 70 will lift away from the floor anchor 18 to allow the entrance door 12 to open.

The motor activating facility 34 includes a receiver 76, as shown in dotted lines in FIG. 6, built into the motor 26. A hand-held remote control transmitter unit 78, as shown in FIGS. 1 and 4, has a compartment 80 for storing a battery 82 therein for supplying electrical power thereto. A forward command button 84 is in the remote control transmitter unit 78. When pressed by a person 85, it will send a signal to the receiver 76 to cause the motor 26 to rotate the externally threaded shaft 62 in the forward direction. A reverse command button 86 is also in the remote control transmitter unit 78. When pressed by the person 85, it will send a signal to the receiver 76 to cause the motor 26 to rotate the externally threaded shaft 62 in the reverse direction.

LIST OF REFERENCE NUMBERS

10 remote controlled door brace
12 entrance door of 16
14 doorknob of 12
16 building
18 floor anchor in 20
20 floor of 16
22 hanger on 14
24 bar
26 motor
28 securing structure
30 adjustable support
32 movable rod assembly
34 motor activating facility
36 metal plate for 18
38 socket in 36
40 hook member for 22
42 pivot pin
44 compartment in 26
46 battery
48 motor mount for 28
50 collar of 48
52 strap of 48
54 leg of 30
56 arm of 30
58 crossbar
60 foot pad
62 externally threaded shaft of 26
64 housing of 32
66 longitudinal slot of 64
68 sleeve between 26 and 64
70 anchor rod
72 internally threaded socket on 70
74 slide guide pin
76 receiver of 34
78 hand-held remote control transmitter unit of 34
80 compartment in 78
82 battery
84 forward command button in 78
85 person
86 reverse command button in 78

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A remote controlled door brace for an entrance door with a doorknob in a building, said brace comprising:

a) a floor anchor for mounting into the floor of the building, which is to be spaced away from the entrance door;

b) a hanger to engage with the doorknob on the interior side of the entrance door;

c) a bar projecting downwardly from said hanger;

d) a motor;

e) means for securing said motor to a bottom end of said bar, said means comprising a collar to fit about the bottom end of said bar and a strap affixed to said collar and extending about a top end of said motor;

f) an adjustable support for extending between said motor and the interior side of the entrance door, so as to keep said motor at the proper angle away from the entrance door;

g) a movable rod assembly extending from said motor to said floor anchor; and h) means for activating said motor on the exterior side of the entrance door, so as to operate said movable rod assembly to bear against said floor anchor and buttress the entrance door, to prevent an unauthorized person from jimmying open the entrance door and entering the building.

2. A remote controlled door brace as recited in claim 1, wherein said floor anchor is a metal plate having a socket therein, mounted to the floor of the building.

3. A remote controlled door brace as recited in claim 1, wherein said hanger is a hook member to fit about the doorknob of the entrance door.

4. A remote controlled door brace as recited in claim 3, wherein said hook member includes a pivot pin to engage with a top end of said bar to allow said bar to swing out at a downward angle therefrom.

5. A remote controlled door brace as recited in claim 1, wherein said motor includes a compartment for storing a pair of batteries therein for supplying electrical power.

6. A remote controlled door brace as recited in claim 1, wherein said adjustable support includes:

a) a pair of legs attached to and extending from said motor;

b) a pair of arms, in which each said arm is affixed to and extends between said motor and approximately midway of one said leg;

c) a crossbar extending between said legs; and d) a pair of foot pads, in which each said foot pad is attached to a distal end of one said leg to butt up against the interior side of the entrance door.

7. A remote controlled door brace as recited in claim 1, wherein said motor further includes an externally threaded shaft extending outwardly from a bottom end thereof.

8. A remote controlled door brace as recited in claim 7, wherein said movable rod assembly includes:

a) a housing having a pair of opposite longitudinal slots;

b) a sleeve for attaching said housing to the bottom end of said motor, so that said externally threaded shaft of said motor will extend into said housing;

c) an anchor rod having an internally threaded socket at an upper end to threadably engage with said externally threaded shaft of said motor; and d) a pair of slide guide pins, each said slide guide pin extends from an opposite side of said anchor rod and through one said longitudinal slot in said housing, so that when said externally threaded shaft of said motor rotates in a forward direction in said internally threaded socket of said anchor rod, the bottom end of said anchor rod will bear against said floor anchor to buttress the entrance door, and when said externally threaded shaft of said motor rotates in a reverse direction in said internally threaded socket of said anchor rod, the bottom end of said anchor rod will lift away from said floor anchor to allow the entrance door to open.

9. A remote controlled door brace as recited in claim 1, wherein said motor activating means includes:

a) a receiver built into said motor;

b) a hand-held remote control transmitter unit having a compartment for storing a battery therein for supplying electrical power thereto;

c) a forward command button in said remote control transmitter unit, which when pressed will send a signal to said receiver to cause said motor to rotate said externally threaded shaft in the forward direction; and d) a reverse command button in said remote control transmitter unit, which when pressed will send a signal to said receiver to cause said motor to rotate said externally threaded shaft in the reverse direction.

10. A remote controlled door brace for an entrance door with a doorknob an a building, said brace comprising:

a) a floor anchor for mounting into the floor of the building, which is to be spaced away from the entrance door;

b) a hanger to engage with the doorknob on the interior side of the entrance door;

c) a bar projecting downwardly from said hanger;

d) a motor e) means for securing said motor to a bottom end of said bar;

f) an adjustable support for extending between said motor and the interior side of the entrance door, so as to keep said motor at the proper angle away from the entrance door, said adjustable support including (1) a pair of legs attached to and extending from said motor, (2) a pair of arms, in which each said arm is affixed to and extends between said motor and approximately midway of one said leg, (3) a crossbar extending between said legs, and (4) a pair of foot pads, in which each said foot pad is attached to a distal end of one said leg to butt up against the interior side of the entrance door;

g) a movable rod assembly extending from said motor to said floor anchor; and h) means for activating said motor on the exterior side of the entrance door, so as to operate said movable rod assembly to bear against said floor anchor and buttress the entrance door, to prevent an unauthorized person from jimmying open the entrance door and entering the building.

11. A remote controlled door brace as recited in claim 10, wherein said floor anchor is a metal plate having a socket therein, mounted to the floor of the building.

12. A remote controlled door brace as recited in claim 11, wherein said hanger is a hook member to fit about the doorknob of the entrance door.

13. A remote controlled door brace as recited in claim 12, wherein said hook member includes a pivot pin to engage with a top end of said bar to allow said bar to swing out at a downward angle therefrom.

14. A remote controlled door brace as recited in claim 13, wherein said motor includes a compartment for storing a pair of batteries therein for supplying electrical power.

15. A remote controlled door brace as recited in claim 14, wherein said securing means is a motor mount which includes:

a) a collar to fit about the bottom end of said bar; and b) a strap affixed to said collar and extending about a top end of said motor.

16. A remote controlled door brace as recited in claim 10, wherein said motor further includes an externally threaded shaft extending outwardly from a bottom end thereof.

17. A remote controlled door brace as recited in claim 16, wherein said movable rod assembly includes:

a) a housing having a pair of opposite longitudinal slots;

b) a sleeve for attaching said housing to the bottom end of said motor, so that said externally threaded shaft of said motor will extend into said housing;

c) an anchor rod having an internally threaded socket at an upper end to threadably engage with said externally threaded shaft of said motor; and d) a pair of slide guide pins, each said slide guide pin extends from an opposite side of said anchor rod and through one said longitudinal slot in said housing, so that when said externally threaded shaft of said motor rotates in a forward direction in said internally threaded socket of said anchor rod, the bottom end of said anchor rod will bear against said floor anchor to buttress the entrance door, and when said externally threaded shaft of said motor rotates in a reverse direction in said internally threaded socket of said anchor rod, the bottom end of said anchor rod will lift away from said floor anchor to allow the entrance door to open.

18. A remote controlled door brace as recited in claim 17, wherein said motor activating means includes:

a) a receiver built into said motor;

b) a hand-held remote control transmitter unit having a compartment for storing a battery therein for supplying electrical power thereto;

c) a forward command button in said remote control transmitter unit, which when pressed will send a signal to said receiver to cause said motor to rotate said externally threaded shaft in the forward direction; and d) a reverse command button in said remote control transmitter unit, which when pressed will send a signal to said receiver to cause said motor to rotate said externally threaded shaft in the reverse direction.

* * * * *